United States Patent [19]

Fuchs et al.

[11] Patent Number: 4,720,986

[45] Date of Patent: Jan. 26, 1988

[54] SPOOL MOUNTING APPARATUS AND METHOD OF USING THE SAME

[75] Inventors: Hans Fuchs; Hans Baumgartner, both of Uerikon; Alfred Freitag, Männedorf, all of Switzerland

[73] Assignee: Maschinenfabrik Schärer AG, Erlenbach, Switzerland

[21] Appl. No.: 740,026

[22] Filed: May 31, 1985

[30] Foreign Application Priority Data

Jun. 12, 1984 [CH] Switzerland ..... 2823/84
Apr. 29, 1985 [CH] Switzerland ..... 1811/85

[51] Int. Cl.[4] ..... D06F 17/04

[52] U.S. Cl. ..... 68/198; 68/189; 242/118.41; 242/118.61; 242/125

[58] Field of Search ..... 68/198, 189; 242/118.41, 118.6, 118.61, 118.62, 125

[56] References Cited

U.S. PATENT DOCUMENTS

| | | | |
|---|---|---|---|
| 1,928,251 | 9/1933 | Gollong | 68/198 |
| 1,972,150 | 9/1934 | Kraft | 68/198 |
| 2,011,485 | 8/1935 | Huttinger | 68/198 |
| 2,656,703 | 10/1953 | Zingg | 68/198 |
| 3,045,944 | 7/1962 | Ciniglio | 68/198 X |
| 3,086,381 | 4/1963 | Jackson | 68/198 |
| 3,115,025 | 12/1963 | Drago | 68/198 |
| 3,408,023 | 10/1968 | Alexander et al. | 242/118.61 X |
| 3,731,502 | 5/1973 | Stearns et al. | 68/198 |

FOREIGN PATENT DOCUMENTS

| | | | |
|---|---|---|---|
| 59-94669 | 5/1984 | Japan | 68/198 |

*Primary Examiner*—Harvey C. Hornsby
*Assistant Examiner*—Frankie L. Stinson
*Attorney, Agent, or Firm*—Werner W. Kleeman

[57] ABSTRACT

Cap members are placed at the lower end of the perforated bottom spool sleeve and at the top end of the perforated top spool sleeve of a series of package-containing spools mounted at a perforated tube or sword. The cap members prevent, during treatment of the package-containing spools with a suitable treatment fluid or agent like, for example, a dyeing or bleaching fluid, the escape of such treatment fluid at each of the connecting locations between the perforated sleeve of the bottom spool and a base plate as well as between the perforated sleeve of the top spool and a chuck-type or clamping closure member. The end portions of the perforated sleeves are constructed such that no treatment fluid can escape at the connecting locations between the perforated sleeves of adjacent spools in the series of package-containing spools mounted at the associated perforated tube.

37 Claims, 9 Drawing Figures

SPOOL MOUNTING APPARATUS AND METHOD OF USING THE SAME

BACKGROUND OF THE INVENTION

The present invention relates to a new and improved construction of an apparatus for mounting package-containing spools for the joint treatment of a series of such spools. The present invention also relates to a new and improved method of using such apparatus.

In an apparatus, for example, for performing a dyeing or bleaching treatment, the package-containing spools, which are to be dyed or bleached, are mounted at a spool or material carrier. In order to enable unobstructed throughflow of the treatment fluid or agent through the spools, the package-containing spools are mounted at perforated tubes or swords, and are chucked or clamped between a base plate which is mounted at the lower end of the perforated tube or sword and a chuck-type or clamping closure or locking member which is placed at the top end of such perforated tube or sword.

Known base plates and chuck-type or clamping closure or locking members have the disadvantage that the treatment fluid or bath which is introduced into the spools under pressure through the perforated tube or sword, can also escape at the two ends of the perforated sleeves of the package-containing spools instead of just through the package-containing spools. There are thus substantial losses of the treatment fluid due to such leakage, and such losses become particularly significant in the case of dense packages of the type which are obtained as a result of precision winding operations.

SUMMARY OF THE INVENTION

Therefore, with the foregoing in mind, it is a primary object of the present invention to provide a new and improved construction of an apparatus for mounting package-containing spools for the joint or simultaneous treatment of a series of such spools and which apparatus is not afflicted with the aforementioned drawbacks and limitations of the prior art constructions heretofore discussed.

Another and more specific object of the present invention is directed to a new and improved construction of an apparatus for mounting package-containing spools for the joint or simultaneous treatment of a series of such spools and in which a reliable sealing against unwanted leakage of the treatment fluid or agent is ensured at the ends of the sleeves of the spools.

Another significant object of the present invention is directed to a new and improved construction of an apparatus for mounting package-containing spools for the joint or simultaneous treatment of a series of such spools and in which the perforated sleeves of the spools are mounted at perforated tubes or swords in such a manner that the package-containing spools can be further processed after the treatment without a further rewinding operation.

Now in order to implement these and still further objects of the invention, which will become more readily apparent as the description proceeds, the apparatus of the present development is manifested by the features that, a first cap member is inserted between the base plate and the bottom spool of the series of spools mounted at the perforated tube or sword and forms a seal between such base plate and the sleeve of the bottom spool, and a second cap member is inserted between the chuck-type or clamping closure or locking member and the top spool of the series of spools mounted at the perforated tube or sword and forms a seal between the chuck-type or clamping closure or locking member and the sleeve of the top spool.

Advantageously, and by installing the cap members at the ends of the perforated tubes or swords and at the perforated sleeves of the package-containing spools located at such perforated tube ends and also under certain circumstances between a perforated sleeve of a package-containing spool and a non-perforated sleeve of a blind spool, there is thus successfully prevented the exit or escape of the treatment fluid or agent at such locations and there is thus obtained a reliable throughflow or throughpassage of the treatment fluid or agent through the material to be treated, i.e. through the packages of the package-containing spools.

Due to the fact that the end faces of the package-containing spools in the inventive apparatus now can be arranged in a spaced relationship with respect to each other because no treatment fluid or agent can directly escape at the ends of the sleeves of such spools, there is completely prevented felting of the end faces of the spools. The treatment fluid or agent can unobstructedly exit from the spool end faces as well as through the circumferential surfaces of the package-containing spools, and there is thus ensured uniform treatment, for example, dyeing or bleaching of the packages of the series of package-containing spools.

Preferably, the cap members are provided with recesses or cut-outs in order to effect accurate positioning of the cap members at the sleeve ends or end portions. For certain of the cap members such recesses or cut-outs may possess an annular shape. The deeper recess in the bottom cap member, which may be an annular-shaped recess, ensures excellent sealing even if the package-containing spools are somewhat lifted or raised from the base plate under the action of the excess pressure prevailing within the sleeves of such spools. By using a thin-walled collar with a diameter which is smaller than the sleeve diameter, there can be obtained a high surface pressure which is exerted by the cap member at the base plate with increasing pressure of the treatment fluid and there is thus prevented a lift-off of the cap member from the associated base plate.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
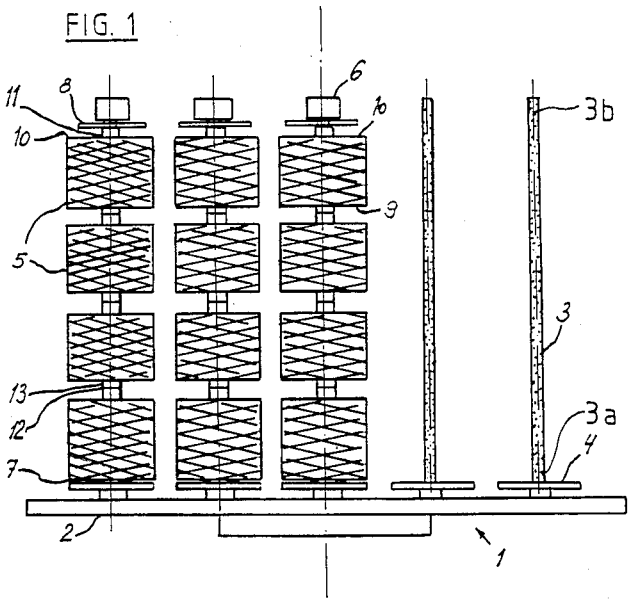
FIG. 1 is a view of a first embodiment of the inventive apparatus which is partially occupied with package-containing spools.

Describing now the drawings, it is to be understood that only enough of the construction of the apparatus has been shown as needed for those skilled in the art to readily understand the underlying principles and concepts of the present development, while simplifying the showing of the drawings. Turning attention now specifically to FIG. 1, there has been shown in a partially sectional side view a spool or material carrier 1. A carrier plate or support 2 of the spool or material carrier 1 contains a multitude of perforated tubes or swords 3 which may be arranged along the periphery of the spool or material carrier 1 and which are threadably connected or plugged into the carrier plate 2. The perforated tubes or swords 3 are of conventional structure and, therefore, are not further described herein in any particular detail. At a lower end 3*a* of each one of the perforated tubes or swords 3 there is mounted a base plate 4 which supports or series of package-containing spools 5 which are pushed or threaded onto the perforated tube or sword 3. A chuck-type or clamping closure or locking member 6 is placed upon an upper or top end 3*b* of each one of the perforated tubes or swords 3. Both the base plate 4 and the chuck-type or clamping closure or locking member 6 are releasably connected to the associated perforated tube or sword 3. The treatment fluid or agent like, for example, a dyeing or bleaching fluid or agent is introduced in known manner into the perforated tubes or swords 3 via the carrier plate 2.

Each one of the package-containing spools 5 contains a sleeve 13 structured to pass the treatment fluid or agent through its sleeve wall, such as a perforated sleeve, with a first or lower sleeve end portion 12 and a second or upper sleeve end portion 11. A first cap member 7 is inserted between the base plate 4 and the first or lower sleeve end portion 12 of the sleeve 13 which is associated with the bottom spool of the series of package-containing spools 5 pushed onto the associated perforated tube or sword 3. A second cap member 8 is inserted between the chuck-type or clamping closure or locking member 6 and the second or upper sleeve end portion 11 of the sleeve 13 which is associated with the top spool of the series of package-containing spools 5 pushed or threaded onto the perforated tube or sword 3. The first or lower sleeve end portion 12 of the sleeve 13 of the bottom spool of the series of package-containing spools 5 engages the first cap member 7. The second or upper sleeve end portion 11 of the sleeve 13 of the top spool in the series of package-containing spools 5 engages the second cap member 8. As a result, the first cap member 7 does not contact the therewith confronting end face 9 of the bottom spool and the second cap member 8 does not contact the therewith confronting end face 10 of the top spool of the series of package-containing spools 5 pushed onto the associated perforated tube or sword 3.

Figure 3:
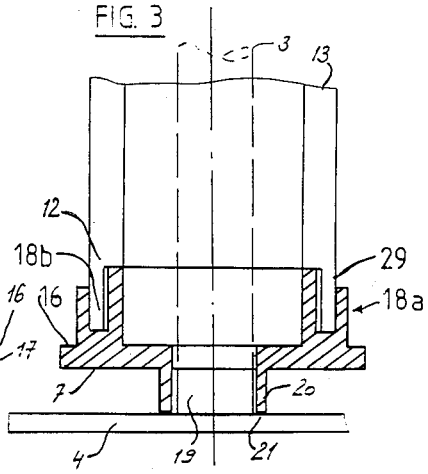
FIG. 3 is a cross-section through a first cap member sealingly arranged at the bottom spool of the series of package-containing spools illustrated in FIG. 1.

The first cap member 7 is sealingly arranged intermediate the base plate 4 and the bottom spool of the series of package-containing spools 5 mounted at or pushed onto the associated perforated tube or sword 3. As illustrated in FIG. 3, the first cap member 7 is provided on its top side, i.e. on the side facing the first or lower sleeve end portion 12 of the sleeve 13 of the bottom spool, with a collar 18*a* which is spaced from and extends along the periphery of the first cap member 7. An annular recess or cut-out 18*b* is formed in the collar 18*a* and has a predetermined depth. The first or lower sleeve end portion 12 is accommodated with slight play in the recess or cut-out 18*b* and there is thus permitted some relative movement between the first or lower sleeve end portion 12 and the first cap member 7 for a purpose to be described hereinafter.

A shoulder 16 is formed on the top side of the first cap member 7 between the collar 18*a* and the periphery of such cap member 7. The shoulder 16 constitutes an accommodating member which serves to accommodate a first cover plate or spider 17 of conventional design.

The first cap member 7 is provided with a central opening or aperture 19. On the bottom side of the first cap member 7, i.e. on the side remote from the bottom spool of the series of package-containing spools 5 pushed onto the associated perforated tube or sword 3, there is placed or formed a cylindrical, hollow and thin-walled protrusion or collar 20 with an end or end face 21. The protrusion or collar 20 engages the base plate 4 with its end or end face 21. This protrusion or collar 20 has a diameter of a size which is as small as permitted by the diameter of the associated perforated tube or sword 3 in order to tightly enclose the latter.

Figure 2:
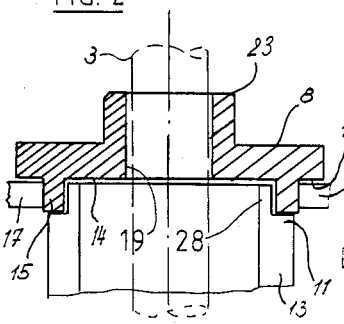
FIG. 2 is a cross-section through a second cap member sealingly arranged at the top spool in the series of package-containing spools illustrated in FIG. 1.

The second cap member 8 as illustrated in FIG. 2 is sealingly arranged intermediate the chuck-type or clamping closure or locking member 6 of the top spool of the series of package-containing spools 5 mounted at the perforated tube or sword 3. On its underside, i.e. on the side facing the second or upper sleeve end portion 11 of the sleeve 13 of the top spool in the aforementioned series of package-containing spools 5, the second cap member 8 contains a collar 15 which is spaced from and extends along and adjacent the periphery of the second cap member 8. The second or upper sleeve end portion 11 of the sleeve 13 of the aforementioned top spool is inserted into a recess or cut-out 14 which is bounded by the collar 15. The recess or cut-out 14 has a predetermined depth which is smaller than the predetermined depth of the recess or cut-out 18*b* which is formed in the collar 18*a* of the first cap member 7. The recess or cut-out 14 also has a predetermined width or diameter which is slightly greater than the predetermined width or diameter of the second or upper sleeve end portion 11 accommodated by the recess 14.

A shoulder 16 is formed between the collar 15 and the periphery of the second cap member 8. This shoulder 16 constitutes an accommodating member which serves to accommodate a second cover plate or spider 17 of conventional design.

The second cap member 8 contains a central opening or aperture 19. On the top side, i.e. on the side remote from the top spool of the series of package-containing spools 5 pushed onto the associated perforated tube or sword 3, the second cap member 8 is provided with a preferably circular annularly-shaped protrusion or collar 23 which serves the purpose of centering the sleeve 13 of the top spool of the aforementioned series of package-containing spools 5 at the chuck-type locking member 6 which is placed upon the top end **3*b* of the associated perforated tube or sword 3**.

A blind spool 22 constituting a blind, i.e. a non-perforated sleeve is used to fill-up or complete a possibly existing incomplete series of package-containing spools 5 at the associated perforated tube or sword 3. In the second exemplary embodiment illustrated in FIG. 6, the blind spool 22 is placed on top of the incomplete series of package-containing spools 5 and between the adjacent top spool of such series and the chuck-type locking member 6 at the associated perforated tube or sword 3. The blind or non-perforated sleeve **22*c* of the blind spool 22 possesses a first or lower end portion 22*a* and a second or upper end portion 22*b*. A further cap member 24 is sealingly arranged intermediate the first end portion 22*a* of the blind sleeve 22*c* of the blind spool 22 and the second or upper sleeve end portion 11 of the sleeve 13 of the aforementioned top spool of the incomplete series of package-containing spools 5**.

Figure 4:
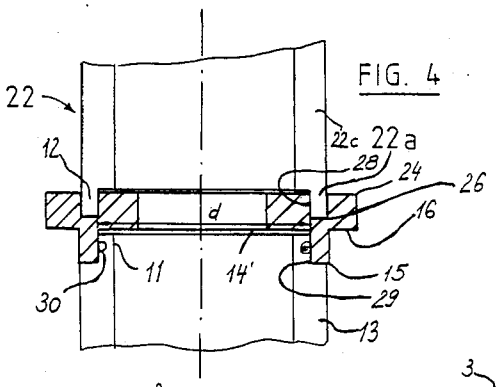
FIG. 4 is a cross-section through a further cap member for providing a sealing arrangement at a blind spool.
Figure 5:
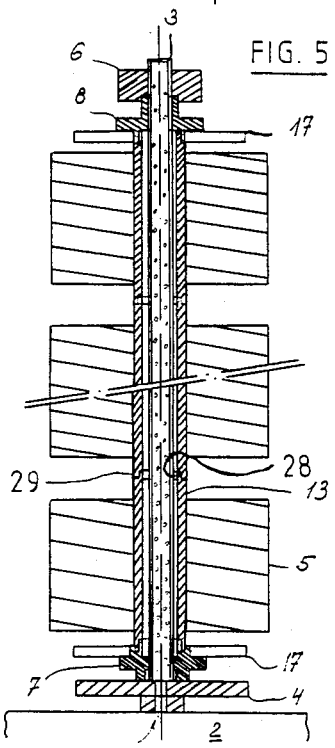
FIG. 5 is a view similar to FIG. 1 of a single perforated tube or sword with a base plate and a chuck-type or clamping closure or locking member and a series of package-containing spools mounted thereat.

The further cap member 24 is illustrated in greater detail in FIG. 4. On its underside, i.e. on the side facing the second or upper sleeve end portion 11 of the sleeve 13 of the aforementioned top spool of the incomplete series of package-containing spools 5, the further cap member 24 is provided with a collar 15 which is spaced from and extends along and adjacent the periphery of such further cap member 24. A recess or cut-out 14' is bounded by the collar 15 and serves to receive the second or upper sleeve end portion 11 of the sleeve 13 of the aforementioned top spool. The recess or cut-out 14' has a predetermined depth which is smaller than the predetermined depth of the recess or cut-out **18*b* formed in the first cap member 7. A shoulder 16 is formed between the collar 15 and the periphery of the further cap member 24. This shoulder 16 constitutes an accommodating member which serves to accommodate a cover plate or spider 17, see FIG. 6**.

A sealing ring, for example, an O-ring 30 may be placed on the inside of the collar 15 at the further cap member 24 in order to improve the seal between such collar 15 and the second or upper sleeve end portion 11 of the sleeve 13 which is associated with the top spool of the incomplete series of package-containing spools 5 pushed onto the associated perforated tube or sword 3.

On its top side, i.e. on the side remote from the second or upper sleeve end portion 11 of the sleeve 13 of the top spool of the incomplete series of package-containing spools 5 pushed onto the associated perforated tube or sword 3, the further cap member 24 is provided with an accommodating member constituting a recess 26 which accommodates the first or lower end portion **22*a* of the blind or non-perforated sleeve 22*c* of the blind spool 22. Like the recess 18*b* formed in the collar 18*a* at the first cap member 7, the first or lower end portion 22*a* of the blind spool 22 is received with slight play in the recess 26 in order to obtain a favorable sealing action. Preferably, the recess 26 is of a circular annular shape. The recess 26 has a predetermined width or diameter which is slightly greater than the predetermined width or diameter of the first or lower end portion 22*a* of the blind spool 22 and which is accommodated by the recess 26**.

The accommodating member at the further cap member 24 which accommodates the first or lower end portion **22*a* of the non-perforated sleeve 22*c* of the blind spool 22, may also be structured as an annular protrusion or yoke formed on the top side of the further cap member 24, and the blind spool 22** is pushed onto such protrusion or yoke during assembly.

Preferably, the first or lower sleeve end portion 12 and the second or upper sleeve end portion 11 of each sleeve 13 are constructed such that the sleeve end portions of the sleeves 13 of adjacent spools in the series of package-containing spools 5 can be interengaged in such a manner that a sealed connection is formed between the sleeves 13 of adjacent spools. In the exemplary embodiments illustrated in FIGS. 1 to 6, the first or lower sleeve end portion 12 is formed with an engaging member constituting an internal recess 28, and the second or upper sleeve end portion 11 is formed with an engaging member constituting an external recess 29. The recesses 28 and 29 are shaped in a substantially complementary manner, so that the internal diameter of the internal recess 28 at the first or lower sleeve end portion 12 is approximately equal to the outer or external diameter of the external recess 29 formed at the second or upper sleeve end portion 11.

In order to improve the seal between the interengaging adjacent spools of the series of package-containing spools 5 pushed onto the associated perforated tube or sword 3, there can be additionally provided a sealing ring like, for example, an O-ring 30 preferably in the external recess 29 formed at the second or upper sleeve end portion 11.

Figure 6:
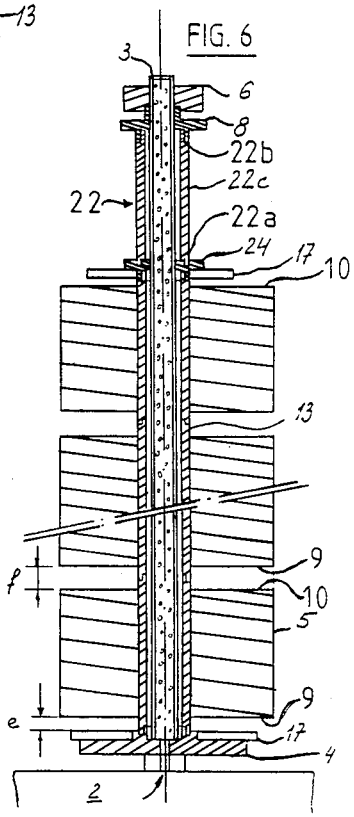
FIG. 6 is a view similar to FIG. 5 and shows a second embodiment of the inventive apparatus with a blind spool placed at the top of the series of package-containing spools mounted at the perforated tube and with a modified first cap member.

As illustrated in FIG. 6 for the second exemplary embodiment of the inventive apparatus, the first cap member 7 may also form a member of the base plate 4; also the top side of the base plate 4 may be structured like the top side of the first cap member 7. This construction is particularly useful in cases in which there is not already present an existing spool or material carrier 1, but in which a novel apparatus or installation containing perforated tubes or swords 3 must be equipped from the beginning with the cap members of the inventive apparatus.

In the assembled state of the inventive apparatus, as particularly illustrated for the second exemplary embodiment in FIG. 6, the lower end face 9 of the bottom spool in the series of package-containing spools 5 pushed onto the associated perforated tube or sword 3, is spaced by a small distance e from the cover plate or spider 17. The upper end face 10 of this bottom spool is spaced by a predetermined distance f from the lower end face 9 of the spool placed adjacently atop the bottom spool in the series of package-containing spools 5.

In the assembled state of the inventive apparatus, the first or lower end portion 12 of the sleeve 13 of the bottom spool in the series of package-containing spools 5 pushed onto the associated perforated tube or sword 3, is located within the recess or cut-out **18*b* of the collar 18*a* formed at the first cap member 7. When the perforated tube or sword 3 is completely loaded by the series of package-containing spools 5, the second or upper sleeve end portion 11 of the sleeve 13 of the top spool in such series of package-containing spools 5, is located in the recess or cut-out 14 formed at the second cap member 8, see FIGS. 2 and 5. When the perforated tube or sword 3 is incompletely loaded by an incomplete series of package-containing spools 5 and when at least one blind spool 22 is required on top of the incomplete series of package-containing spools 5, the second or upper sleeve end portion 11 of the sleeve 13 of the top spool in the incomplete spool series is located within the recess or cut-out 14' of the further cap member 24, see FIGS. 4 and 6. The blind spool or the top blind spool 22, as the case may be, is sealingly closed at the second end portion 22*b* thereof by means of a second cap member 8 which is engaged by the chuck-type or clamping locking member 6. In such a manner also the incomplete series of spools pushed onto the associated perforated tube or sword 3 is clamped against the base plate 4 by means of the chuck-type or clamping locking member 6**.

In the heretofore described and illustrated exemplary embodiments, the sealing action between the first or lower sleeve end portion 12 of the sleeve 13 of the bottom spool and the first cap member 7 as well as between the second or upper sleeve end portion 11 of the sleeve 13 of the top spool of the series of package-containing spools 5 and the second cap member 8, and the seal between the first cap member 7 and the base plate 4 as well as between the second cap member 8 and the chuck-type or clamping locking member 6 is predominantly obtained by a precisely fitting shape of the interengaging members and is due to a lesser extent to an elastic deformation of the first cap member 7 and of the second cap member 8. However, perfect sealing can also be obtained by employing elastic sealing cap members in combination with conventional cover plates or spiders and corresponding exemplary embodiments will now be described in detail hereinafter.

Figure 7:
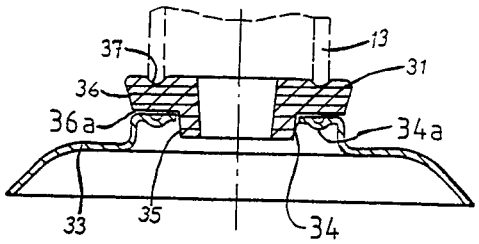
FIG. 7 is a cross-sectional view of a conventional plate or spider in combination with an elastic sealing cap member according to a third embodiment of the inventive apparatus.

As shown in FIG. 7 for a third exemplary embodiment of the inventive apparatus, an elastic sealing cap member 31 is loosely placed upon a cover plate or spider 33. The elastic sealing cap member 31 traverses a central opening or aperture 34 which is formed in the cover plate or spider 33. The elastic sealing cap member 31 contains a conical section or portion 35 and an annular section or portion 36. A shoulder **36*a* is formed between the annular section or portion 36 and the conical section or portion 35. In the assembled state the shoulder 36*a* is placed on top of a rim portion 34*a* which bounds the central opening or aperture 34 formed in the cover plate or spider 33. Guide means are provided on the top side of the annular section or portion 36 and guide the sleeve 13 of a package-containing spool 5 which is placed on the elastic sealing cap member 31. In the illustrated exemplary embodiment the guide means constitute a groove 37 which is spaced from and extends along the periphery of the annular section or portion 36. In the illustrated exemplary embodiment the shoulder 36*a* is formed between the conical section or portion 35 and the annular section or portion 36**.

Figure 8:
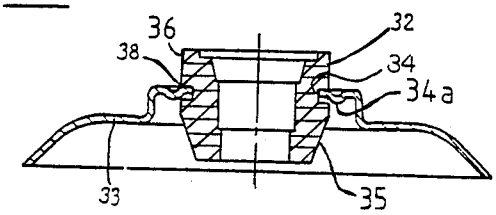
FIG. 8 is a cross-sectional view of a conventional spider or plate in combination with an elastic sealing cap member according to a fourth embodiment of the inventive apparatus.

In the fourth exemplary embodiment of the inventive apparatus illustrated in FIG. 8, an elastic sealing cap member 32 also comprises a conical section or portion 35 and an annular section or portion 36 and traverses a central opening or aperture 34 formed in a cover plate or spider 33. A rim portion **34*a* which bounds the central opening or aperture 34 in the cover plate or spider 33, is received in a circumferential groove 38 which is formed on the outside of the elastic sealing cap member 32 in order to hold the elastic sealing cap member 32 at the cover plate or spider 33**.

Figure 9:
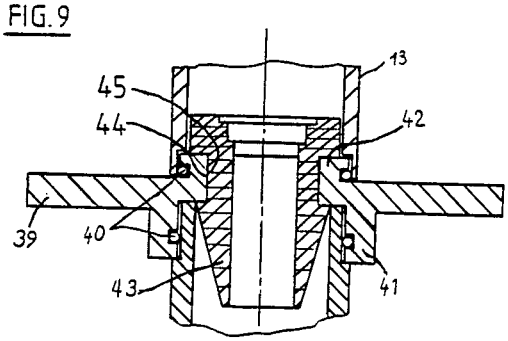
FIG. 9 is a cross-sectional view of a cap member containing a sealing cap member and an elastic sealing cap member of a fifth embodiment of the inventive apparatus.

In the fifth exemplary embodiment of the inventive apparatus illustrated in FIG. 9 sealing is provided by a modified cap member comprising a plate-like sealing cap member 39 and an elastic sealing cap member 43.

The plate-like sealing cap member 39 is provided with a stepped central opening or aperture 44 which is bounded by collar-shaped protrusions 41 and 42 which extend to opposite sides of this plate-like sealing cap member 39.

The first collar-shaped protrusion 41 bounds the wider part of the stepped central opening or aperture 44 and accommodates, as the case may be, either the second or upper sleeve end portion 11 of the sleeve 13 of the top spool in the series of package-containing spools 5 pushed onto the associated perforated tube or sword 3 or a correspondingly shaped member formed on the top side of the base plate 4. The second collar-shaped protrusion 42 engages a circumferential groove 45 formed at the elastic sealing cap member 43 on the inside thereof. On its outside the second collar-shaped protrusion 42 accommodates, as the case may be, either the first or lower sleeve end portion 12 of the sleeve 13 of the bottom spool in the series of package-containing spools 5 pushed onto the perforated tube or sword 3 or a correspondingly shaped member formed on the underside of the chuck-type or clamping closure or locking member 6.

Sealing rings like, for example, O-rings 40 are inserted into related grooves formed in the sealing surfaces of the collar-shaped protrusions 41 and 42. Each of the collar-shaped protrusions 41 and 42 has an axial length which is sufficient to maintain the associated sleeve end portion 11 or 12 in engagement with the associated sealing ring or O-ring 40 when the sleeve 13 of the bottom spool of the series of package-containing spools 5 is slightly lifted-off from the sealing cap member 39 due to the pressure of the treatment fluid prevailing within the sleeve 13.

In the exemplary embodiments illustrated in FIGS. 7 to 9, the elastic sealing cap members 31, 32 and 43 are preferably made of a suitable heat-resistant material like, for example, rubber which is also resistant against chemicals.

In the assembled state of the inventive apparatus the spool or material carrier 1 is placed into an autoclave and the treatment fluid or agent like, for example, a dyeing or bleaching liquid or bath is pumped in known manner through the perforated tubes or swords 3. Due to the interengaging sleeve end portions 11 and 12 no measurably effective leakages occur at the connecting locations between adjacent spools of the series of package-containing spools 5 pushed onto the associated perforated tube or sword 3. The same is also true for the connecting locations between the first or lower sleeve end portions 12 and the first cap member 7 or the sealing cap member 39 as well as between the second or upper sleeve end portion 11 and the second cap member 8 or the sealing cap member 39.

The thin-walled protrusion or collar 23 formed at the second cap member 8 as well as the protrusion or collar 20 formed at the first cap member 7 engage the chuck-type locking member 6 and the base plate 4, respectively, with a very high surface pressure. This is due to the fact that the diameters of both of the protrusions or collars 20 and 23 are maintained small and that their engagement surface is correspondingly small.

In the exemplary embodiments in which the only slightly elastic first and second cap members 7 and 8 which form the connecting elements between the sleeves 13 or 22 and the chuck-type locking member 6 and the base plate 4, are replaced by the elastic sealing cap members 31 and 32 which are made of a soft material like, for example, rubber, the sealing action thereof is effected by a relatively large-dimensioned sealing surface.

As a matter of experience the series of package-containing spools 5 which are pushed onto the associated perforated tube or sword 3, are lifted or raised to some degree under the action of the pressure generated by the treatment fluid or agent. As a consequence, the first or lower sleeve end portion 12 of the sleeve 13 of the bottom spool in the series of package-containing spools 5 pushed onto the associated perforated tube or sword 3, is lifted-off to some degree from the first cap member 7 or from the sealing cap member 39. Due to the greater depth of the recess or cut-out **18*b* in the collar 18*a* formed at the first cap member 7 or due to the length of the second collar-shaped protrusion 42 at the sealing cap member 39, there is always maintained a guiding action and consequently also a sealing action between the sleeve 13 and the cap member 7 or the sealing cap member 39**, as the case may be.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. An apparatus for mounting package-containing spools for the joint treatment of a series of such spools, comprising:

a carrier;

at least one perforated tube mounted at said carrier and through which perforated tube there can be supplied a treatment fluid;

said at least one perforated tube possessing an upper end and a lower end;

a clamping locking member releasably connectable to said upper end of said at least one perforated tube;

a base plate releasably connectable to said lower end of said at least one perforated tube;

a first cap member sealingly arranged intermediate said base plate connected to said lower end of said perforated tube and a sleeve end portion of a bottom spool of a series of package-containing spools mounted at said at least one perforated tube; and a second cap member sealingly arranged intermediate a clamping locking member connected to said upper end of said at least one perforated tube and a sleeve end portion of a top spool of said series of package-containing spools mounted at said at least one perforated tube.

2. The apparatus as defined in claim 1, wherein:

each said spool comprises a sleeve;

said sleeve possessing a first sleeve end portion and a second sleeve end portion; and said second cap member, on a side thereof facing said second sleeve end portion, containing a recess accommodating said second sleeve end portion of said sleeve.

3. The apparatus as defined in claim 2, wherein:

said second sleeve end portion possesses a predetermined dimension;

said recess formed in said second cap member possessing a predetermined dimension; and said predetermined dimension of said recess being slightly greater than said predetermined dimension of said second sleeve end portion.

4. The apparatus as defined in claim 1, further including:

a blind spool mounted at said at least one perforated tube; and a further cap member sealingly arranged between said blind spool and an adjacent spool of said series of package-containing spools mounted at said at least one perforated tube.

5. The apparatus as defined in claim 4, wherein:

said blind spool contains a non-perforated sleeve;

said non-perforated sleeve possessing a first end portion and a second end portion; and said further cap member, on a side thereof facing said first end portion of said non-perforated sleeve, containing an accommodating member accommodating said first end portion of said non-perforated sleeve.

6. The apparatus as defined in claim 5, wherein:

said first end portion of said non-perforated sleeve has a predetermined dimension;

said accommodating member of said further cap member possessing a recess of a predetermined dimension; and said predetermined dimension of said recess being slightly greater than said predetermined dimension of said second end portion of said non-perforated sleeve.

7. The apparatus as defined in claim 6. wherein:

said recess in said further cap member constitutes a circular annularly-shaped recess.

8. The apparatus as defined in claim 6, wherein:

each said spool comprises a sleeve;

said sleeve possessing a first sleeve end portion and a second sleeve end portion;

said first cap member, on a side thereof facing said first sleeve end portion, containing an annularly-shaped recess accommodating said first sleeve end portion and having an predetermined depth; and said predetermined depth of said annularly-shaped recess formed in said first cap member being greater than said predetermined depth of said recess formed in said further cap member.

9. The apparatus as defined in claim 5, wherein:

said accommodating member of said further cap member constitutes a protrusion accommodating said second end portion of said non-perforated sleeve.

10. The apparatus as defined in claim 4, further including:

a cover plate;

said further cap member, on a side thereof facing said series of package-containing spools mounted at said at least one perforated tube in the assembled state of said apparatus, being provided with an accommodating member; and said accommodating member accommodating said cover plate in an assembled state of said apparatus.

11. The apparatus as defined in claim 10, wherein:

said accommodating member provided at said further cap member constitutes a shoulder.

12. The apparatus as defined in claim 10, wherein:

said accommodating member provided at said further cover plate constitutes a recess.

13. The apparatus as defined in claim 10, wherein:
said cover plate constitutes a spider.

14. The apparatus as defined in claim 4, wherein:
said further cap member constitutes an elastic sealing cap member.

15. The apparatus as defined in claim 14, further including:
a cover plate possessing a central aperture; and
said elastic sealing cap member constituting said further cap member comprising a section which extends through said central aperture of said cover plate.

16. The apparatus as defined in claim 15, wherein:
said elastic sealing cap member is provided with a circumferential groove;
said central aperture of said further cover plate being bounded by a rim portion; and
said rim portion of said further cover plate being held in said circumferential groove of said elastic sealing cap member.

17. The apparatus as defined in claim 16, wherein:
said blind spool comprises a non-perforated sleeve with two end portions; and
said elastic sealing cap member, on its side facing one of said two end portions of said non-perforated sleeve, being provided with guide means for said one end portion of said non-perforated sleeve.

18. The apparatus as defined in claim 17, wherein:
said guide means constitute an annular groove formed in said elastic sealing cap member on said side thereof which faces said one end portion of said non-perforated sleeve.

19. The apparatus as defined in claim 15, wherein:
said cover plate constitutes a spider.

20. The apparatus as defined in claim 1, wherein:
each said spool comprises a sleeve; and
said second cap member, on a side thereof facing said clamping locking member, possessing a circular annularly-shaped protrusion for centering said sleeve at said clamping locking member.

21. The apparatus as defined in claim 1, wherein:
each said spool comprises a sleeve;
said sleeve possessing a first sleeve end portion and a second sleeve end portion; and
said first cap member, on a side thereof facing said first sleeve end portion, containing an annularly-shaped recess accommodating said first sleeve end portion of said sleeve.

22. The apparatus as defined in claim 21, wherein:
said annularly-shaped recess in said first cap member has a predetermined depth;
said second cap member, on a side thereof facing said second sleeve end portion, containing an annularly-shaped recess of a predetermined depth for accommodating said second sleeve end portion of said sleeve; and
said predetermined depth of said annularly-shaped recess in said second cap member being greater than said predetermined depth of said annularly-shaped recess in said first cap member.

23. The apparatus as defined in claim 1, wherein:
said first cap member, on a side thereof facing said base plate, contains a protrusion; and
said protrusion tightly enclosing said at least one perforated tube and engaging said base plate in an assembled state of the apparatus.

24. The apparatus as defined in claim 1, further including:
a first cover plate and a second cover plate;
each said first cap member and said second cap member being provided, on a side thereof which faces said series of package-containing spools mounted at said at least oen perforated tube, with an accommodating member;
said accommodating member provided at said first cap member accommodating said first cover plate in an assembled state of said apparatus; and
said accommodating member provided at said second cap member accommodating said second cover plate in said assembled state of said apparatus.

25. The apparatus as defined in claim 24, wherein:
each said accommodating member of said first cap member and of said second cap member constitutes a shoulder.

26. The apparatus as defined in claim 24, wherein:
each said accommodating member provided at said first cap member and at said second cap member constitutes a recess.

27. The apparatus as defined in claim 24, wherein:
said first cover plate and said second cover plate constitute a first spider and a second spider.

28. The apparatus as defined in claim 24, wherein:
each one of said first cover plate and said second cover plate constitutes a spider.

29. The apparatus as defined in claim 1, wherein:
each one of said first cap member and said second cap member contain an elastic sealing cap member.

30. The apparatus as defined in claim 29, further including:
a first cover plate and a second cover plate;
each said first cover plate and each said second cover plate possessing a central aperture; and
each said elastic sealing cap member comprising a section which extends through said central aperture in a related one of said first cover plate and of said second cover plate.

31. The apparatus as defined in claim 1, wherein:
each said spool comprises a sleeve;
said sleeve possessing a first sleeve end portion and a second sleeve end portion;
said first sleeve end portion and said second sleeve end portion being provided with engaging members respectively engageable with said first cap member and with said second cap member in an assembled state of said apparatus; and
said engaging members provided at said first sleeve end portion and at said second sleeve end portion constituting substantially complementary shaped engaging members; and
said engaging member of said first sleeve end portion of the sleeve of one spool in said series of package-containing spools mounted at said at least one perforated tube, being sealingly interengaged with said engaging member at said second sleeve end portion of the sleeve of an adjacent spool in said series of package-containing spools in an assembled state of the apparatus.

32. An apparatus for mounting package-containing spools for the joint treatment of a series of such spools, comprising:
a carrier;
at least one perforated tube mounted at said carrier and through which perforated tube there can be supplied a treatment fluid;
said at least one perforated tube possessing an upper end and a lower end;

a clamping locking member releasably connectable to said upper end of said at least one perforated tube;

a base plate releasably connectable to said lower end of said at least one perforated tube;

a first cap member sealingly arranged intermediate said base plate and a bottom spool of a series of package-containing spools mounted at said at least one perforated tube;

a second cap member sealingly arranged intermediate said clamping locking member and a top spool of said series of package-containing spools mounted at said at least one perforated tube;

each one of said first cap member and said second cap member constituting an elastic sealing cap member;

a first cover plate and a second cover plate;

each said first cover plate and each said second cover plate possessing a central aperture;

each said elastic sealing cap member comprising a section which extends through said central aperture in a related one of said first cover plate and of said second cover plate;

said elastic sealing cap member being provided with a circumferential groove;

said central aperture of each one of said first cover plate and said second cover plate being bounded by a related rim portion; and said rim portion bounding said central aperture of each one of said first cover plate and said second cover plate being held in said circumferential groove of said elastic sealing cap member.

33. The apparatus as defined in claim 32, wherein:

each said spool comprises a sleeve with two end portions; and said elastic sealing cap member, on its side facing said series of package-containing spools mounted at said one perforated tube, being provided with guide means for one of said two end portions of the sleeve of an adjacent one of said series of package-containing spools.

34. The apparatus as defined in claim 33, wherein:

said guide means constitute an annular groove formed in said elastic sealing cap member on the side thereof which faces said series of spools.

35. An apparatus for mounting package-containing spools for the joint treatment of a series of such spools, comprising:

a carrier;

at least one perforated tube mounted at said carrier and through which perforated tube there can be supplied a treatment fluid;

said at least one perforated tube possessing an upper end and a lower end;

a clamping locking memer releasably connectable to said upper end of said at least one perforated tube;

a base plate releasably connectable to said lower end of said at least one perforated tube;

a first cap member sealingly arranged intermediate said base plate and a bottom spool of a series of package-containing spools mounted at said at least one perforated tube;

a second cap member sealingly arranged intermediate said clamping locking member and a top spool of said series of package-containing spools mounted at said at least one perforated tube;

each one of said first cap member and said second cap member comprising a sealing cap member and an elastic sealing cap member;

said sealing cap member comprising two collar-shaped protrusions extending to opposite sides of said sealing cap member and bounding a cenral aperture formed in said sealing cap member;

said elastic sealing cap member being provided with a circumferential groove;

one of said two collar-shaped protrusions being engaged with said circumferential groove provided at said elastic sealing cap member;

each said spool comprising a sleeve having a first sleeve end portion and a second sleeve end portion;

said sealing cap member, when arranged at said base plate, sealingly accommodating the first sleeve end portion of the sleeve of the bottom spool in said series of package-containing spools, at said one collar-shaped protrusions on a side remote from said elastic sealing cap member, and sealingly accommodating said base plate by means of the other one of said two collar-shaped protrusions; and said sealing cap member, when arranged at said clamping locking member, sealingly engaging said clamping locking member with said one collar-shaped protrusion on a side thereof which is remote from said elastic sealing cap member, and sealingly accommodating by means of the other one of said two collar-shaped protrusions, said second sleeve end portion of said sleeve of the top spool in said series of package-containing spools.

36. An apparatus for mounting packge-containing spools for the joint treatment of a series of such spools, comprising:

a carrier;

at least one perforated tube mounted at said carrier and through which perforated tube there can be supplied a treatment fluid;

said at least one perforated tube possessing an upper end and a lower end;

a clamping locking member releasably connectable to said upper end of said at least one perforated tube;

a base plate releasably connectable to said lower end of said at least one perforated tube;

a first cap member sealingly arranged intermediate said base plate connected to said lower end of said at least one perforated tube and a sleeve end portion of a bottom spool of a series of package-containing spools mounted at said at least one perforated tube;

a second cap member sealingly arranged intermediate said clamping locking member connected to said upper end of said at least one perforated tube and a sleeve end portion of a top spool of said series of package-containing spools mounted at said at least one perforated tube; and each one of said first cap member and said second cap member containing an elastic sealing cap member.

37. An apparatus for mounting package-containing spools for the joint treatment of a series of such spools, comprising:

a carrier;

at least one perforated tube mounted at said carrier and through which perforated tube there can be supplied a treatment fluid;

said at least one perforated tube possessing an upper end and a lower end;

a clamping locking member releasably connectable to said upper end of said at least one perforated tube;

a base plate releasably connectable to said lower end of said at least one perforated tube;

a first cap member sealingly arranged intermediate said base plate and a bottom spool of a series of package-containing spools mounted at said at least one perforated tube;

a second cap member sealingly arranged intermediate a clamping locking member and a top spool of said series of package-containing spools mounted at said at least one perforated tube;

each said spool of said series of package-containing spools comprising a sleeve;

said sleeve possessing a first sleeve end portion and a second sleeve end portion;

said first sleeve end portion and said second sleeve end portion being provided with engaging members respectively engageable with said first cap member and with said second cap member in an assembled state of said apparatus;

said engaging members provided at said first sleeve end portion and at said second sleeve end portion constituting substantially complementary shaped engaging members; and said engaging member of said first sleeve end portion of the sleeve of one spool in said series of package-containing spools mounted at said at least one perforated tube, being sealingly interengaged with said engaging member at said second sleeve end portion of the sleeve of an adjacent spool in said series of package-containing spools in an assembled state of the apparatus.

* * * * *